United States Patent [19]

Welsh

[11] 4,384,669

[45] May 24, 1983

[54] 26D STITCHER HEAD ADAPATED FOR USE ON 18D STITCHING MACHINES

[76] Inventor: John C. Welsh, 2024 East Lane, New Berlin, Wis. 53151

[21] Appl. No.: 198,195

[22] Filed: Oct. 17, 1980

[51] Int. Cl.[3] ..... B25C 5/11

[52] U.S. Cl. ..... 227/85; 227/129

[58] Field of Search ..... 227/82, 85, 87, 88, 227/90, 129

[56] References Cited

U.S. PATENT DOCUMENTS

| | | | |
|---|---|---|---|
| 1,371,388 | 3/1921 | Nasmith | 227/87 |
| 3,275,210 | 9/1966 | McCain | 227/82 |
| 3,305,154 | 2/1967 | McCain et al. | 227/90 |
| 3,542,271 | 11/1970 | Werstler et al. | 227/90 |
| 3,664,655 | 5/1972 | McCain et al. . | |
| 3,876,129 | 4/1975 | Bulka | 227/88 |

FOREIGN PATENT DOCUMENTS

| | | | |
|---|---|---|---|
| 119418 | 10/1918 | United Kingdom | 227/88 |

*Primary Examiner*—Paul A. Bell

*Assistant Examiner*—Fred A. Silverberg

[57] ABSTRACT

Disclosed is a stitcher head for use with a stitching machine and for use in forming staples from a continuous length of wire and for driving the staples into work. The stitching machine includes a rigid frame having a generally vertical face, a first generally horizontal bar located adjacent the face, the first bar being driven vertically reciprocated, a second generally horizontal bar located adjacent the face and in spaced relation from the first bar, and being vertically reciprocated. The stitcher head is supported by the frame and includes a body having a rearward surface adapted to face the vertical face, and movable members for feeding, cutting, and shaping a continuous length of wire to form a staple and for driving the staple into the work. Also included is a single driving lug drivinly connected to the movable members for driving the movable members and an adapter member adapted to be fixed to the first horizontal bar and including means for driving the lug in response to reciprocal movement of the first bar.

14 Claims, 6 Drawing Figures

26D STITCHER HEAD ADAPATED FOR USE ON 18D STITCHING MACHINES

FIELD OF THE INVENTION

The present invention relates to stitcher machines for use in binding magazines and the like and more particularly to stitcher heads which can be employed on conventional stitcher machines and for permitting a plurality of staples to be positioned in closely adjacent relation.

BACKGROUND PRIOR ART

In the binding of magazines, pamphlets and the like the folded sheets or signatures of the magazine are assembled or gathered one atop another on a saddle conveyor and then passed under a stitching machine in an open face-down relation. See U.S. Pat. Nos. 3,275,210 and 3,542,271. The stitching machine supports a plurality of stitcher heads, shown for example, in U.S. Pat. Nos. 3,876,129 and 3,664,655, each of the stitcher heads being adapted to cut and shape a wire staple and to drive that staple through the magazine to thereby bind the pages of the magazine together. In conventional full size magazines, the stitcher machine employs two or three spaced apart stitcher heads so that each magazine has two or three staples binding it. If smaller magazines are to be bound, the stitcher heads are moved closer together.

Many of the stitching machines presently in common use are described as model 18D stitcher machines and are produced by manufacturers such as McCain Manufacturing Corporation of Chicago, Ill. Such stitching machines employ relatively large stitcher heads, also commonly referred to in the industry as 18D stitcher heads. Such stitcher heads are shown for example by those manufactured by Bostich Corp., Indianapolis, Indiana. While the 18D stitcher heads are advantageous in that they are constructed so as to be particularly durable, long wearing and capable of high speed operation, these advantages are achieved by making the stitcher heads relatively large and of substantial width. The width of the 18D stitcher heads is such that while several staples can be driven through a magazine of a conventional 11 inch height, if the magazine is relatively small, only two staples can be driven into the magazine. In some applications, this is insufficient to properly bind the magazine or pamphlet.

Prior to development of the 18D stitching machines and 18D stitcher heads, stitching machines commonly employed a smaller, substantially narrower stitcher head referred to as a 26D stitcher head, such stitcher heads being produced, for example, by Bostich Corp., Indianapolis, Indiana.

As stated, the stitcher head receives a single strand of wire from a spool and feeds, cuts, and shapes the wire to form a staple and then drives the staple through the open face-down signature. The construction of the 26D stitcher head is such that it includes a single member driven by the stitching machine, the single driven member effecting feeding, cutting, and shaping of the wire and driving of the staple. In order to improve the durability and speed of operation of the stitcher heads, the design of the 18D stitcher head employs two reciprocably driven members rather than a single reciprocably driven member, and the 18D stitching machine includes a first reciprocably driven driver for causing reciprocation of one of the driven members and a second reciprocably driven member for causing reciprocation of the other of the driven members.

While it would be desirable to employ the smaller, narrower 26D stitcher when smaller signatures are to be bound, since they can be positioned in more closely adjacent relation, the 26D stitcher head cannot be employed on an 18D stitcher machine because the 26D stitcher head cannot be fixedly mounted on an 18D machine and the two drive bars of the 18D machine are not adapted to drive the driving member of the 26D stitcher head.

SUMMARY OF THE INVENTION

The present invention provides a means for modifying a 26D stitcher head and in combination with a driving adapter so that the 26D stitcher head can be successfully mounted on an 18D stitching machine and such that the driving member of the 26D stitcher head can be driven by one of the driving members of the 18D machine.

More particularly, the invention includes apparatus for use with a stitching machine and for use in forming staples from a continuous length of wire and for driving the staples into work. The stitching machine includes a rigid frame having a generally vertical face, a first generally horizontal bar located adjacent the face, means for driving the first bar in vertical reciprocal movement, a second generally horizontal bar located adjacent the face and in spaced relation from the first bar, and means for driving the second bar in vertical reciprocal movement. The apparatus comprises a stitcher head supported by the frame and including, a body having a rearward surface adapted to face the vertical face, and means for feeding, cutting, and shaping a continuous length of wire to form a staple and for driving the staple into the work, the means for feeding, cutting and shaping including movable members and a single driving lug drivingly connected to the movable members for driving the movable members, the driving lug projecting from the rearward surface and being movable through a range of movement less than the first horizontal bar. The apparatus further comprises means for drivingly connecting the first horizontal bar to the driving lug and for reciprocably driving the driving lug, the connecting means including an adapter member adapted to be fixed to the first horizontal bar and including means for driving the lug in response to reciprocal movement of the first bar.

One of the principal features of the invention is the provision in the adapter member of an aperture for housing the lug, the aperture being larger than the lug whereby the adapter member transmits downward movement of the first bar of the lug only during a latter portion of the downward movement of the first bar and upward movement to the lug only during a latter portion of the upward movement of the first bar.

Another of the features of the invention is the provision of an adapter which transmits downward movement of the first bar to the lug when the first bar approaches its lower position and upward movement of the first bar to the lug when the first bar approaches its upper position, the aperture having a vertical dimension greater than the thickness of the lug.

The invention further includes a stitching machine for driving staples into work, the stitching machine including a rigid frame having a generally vertical face, a first generally horizontal bar located adjacent the face, means for driving the first bar in vertical reciprocal movement, a second generally horizontal bar located adjacent the face and in spaced relation from the first bar, and means for driving the second bar in vertical reciprocal movement. Also included is a stitcher head supported by the frame and including a vertical body having a rearward surface adapted to face the vertical face, and means for feeding, cutting and shaping a continuous length of wire to form a staple and for driving the staple into the work, the means for feeding, cutting and shaping including movable members and a single driving lug drivingly connected to the movable members for driving the movable members. The driving lug is movable through a range of movement less than the first horizontal bar and projects from the rearward surface so as to be driven by the first horizontal bar.

Means are also provided for drivingly connecting the first horizontal bar to the driving lug for reciprocably driving the driving lug, the connecting means including an adapter member fixed to the first horizontal bar and including means for driving the lug in response to reciprocal movement of the first bar.

One of the features of the invention is that the adapter includes an aperture adapted to house the lug, the aperture in the adapter member being larger than the lug whereby the adapter member transmits downward movement of the first bar to the lug during a portion of the downward movement of the first bar and upward movement to the lug during a portion of the upward movement of the first bar.

Another of the features of the invention is that the adapter transmits downward movement of the first bar to the lug when the first bar approaches its lower position and upward movement of the first bar to the lug when the bar approaches its upper position, the aperture having a vertical dimension greater than the thickness of the lug.

Another of the features of the invention is that the body of the stitcher head includes a vertical portion having upper and lower ends, a projection extending rearwardly from the lower end, and a spacer block secured to the rearwardly extending projection, the spacer block including means for engaging the frame.

Another of the features of the invention is the provision of means for securing the stitcher head to the frame, the securing means including a mounting member fixedly attachable to the frame and extending from the vertical face of the frame. The spacer block includes a first bore adapted to house the mounting member. The stitcher head also includes a second bore extending transversely to the first bore in the spacer block and intersecting the first bore. Means are further provided for clamping the spacer block against the vertical face, the clamping means including a mounting device latch housed in the second bore and engageable with the mounting member.

Other features and advantages of the invention are set forth in the following description, in the drawings, and in the claims.

Figure 1:
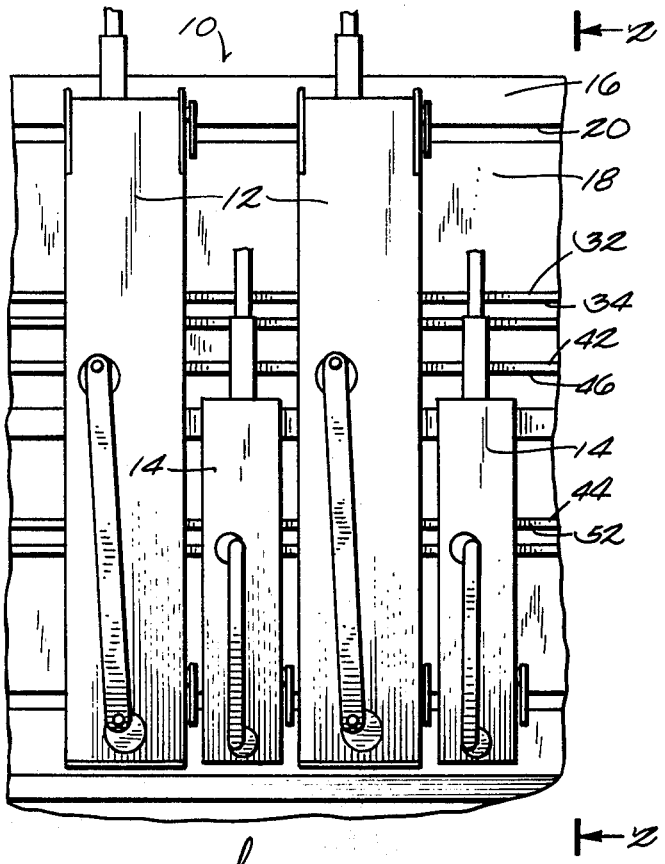
FIG. 1 is a partial elevation view of a stitching machine and showing a plurality of stitcher heads in side-by-side relation.

Before explaining a preferred embodiment in detail, it is to be understood that the invention is not limited in its application to the details of construction and to the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF A PREFERRED EMBODIMENT

Figure 2:
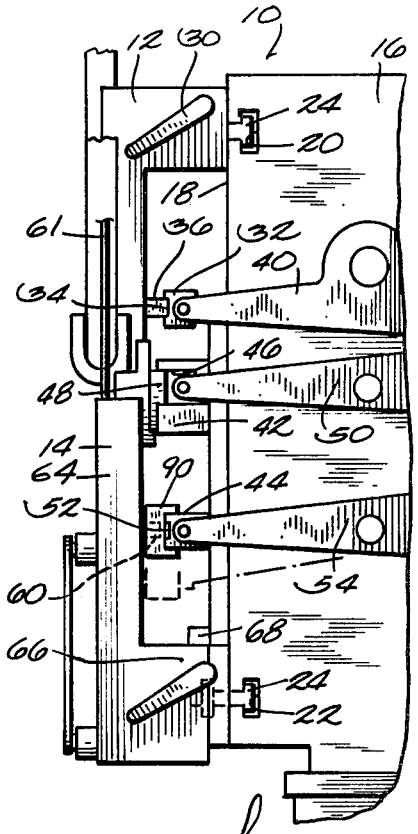
FIG. 2 is a view taken along line 2—2 in FIG. 1.
Figure 3:
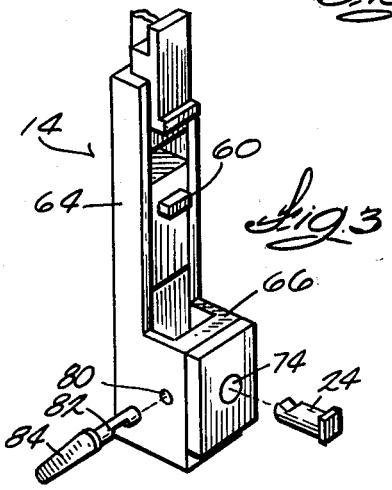
FIG. 3 is a partial perspective view of a stitcher head constructed in accordance with the invention.

Illustrated in FIGS. 1 and 2 is a portion of a conventional 18D stitcher machine 10 supporting a pair of 18D stitcher heads 12 in a conventional manner and a pair of 26D stitcher heads 14 embodying the present invention and employed on the 18D stitcher head in accordance with the present invention.

The 18D stitcher machine 10 is comprised of a frame 16 having a vertical face 18 adapted to support the stitcher heads 12 or 14. The stitcher heads 12 are secured at their upper and lower ends against the vertical face 18. The vertical face includes a pair of horizontal T-shaped slots 20 and 22. A securing member 24 is housed in the slot 20. The securing member 24 extends forwardly from the vertical face 18 and is adapted to be received in an aperture in the rearward face of the stitcher head 12. The stitcher head 12 further includes a lever 30 connected to means (not shown) for releasably engaging the forward end of the securing member 24. A similar securing member 24 extends forwardly from the T-shaped slot 22 and is adapted to be received in an aperture in the rearward surface of the lower portion of the stitcher head 12.

The stitching machine 10 further includes an upper rail or bar 32 including a groove 34 in its forward face. An alignment member or positioning member 36 of the stitcher head 12 is positionable in the groove 34. Vertical movement of the positioning member 36 controls the positioning of the wire bending and driving means with respect to the signatures. The upper rail 32 is supported for selective vertical adjustment by levers 40 (one shown) at its opposite ends.

The stitching machine 10 also includes a pair of vertically spaced apart driving bars 42 and 44, the bars 42 and 44 being adapted to drive various wire feeding and bending members of the 18D stitcher head 12. The upper driving bar 42 is supported for vertical reciprocal movement and includes a linear groove 46 in its forward face. The stitcher heads 12 each include a driven member 48 which drives various wire bending and driving components of the stitcher head. The driven member 48 is positioned in the linear groove 46 so as to be reciprocably driven by reciprocal movement of the upper driving bar 42. The upper driving bar 42 is driven by lever arms 50 (one shown) at its opposite ends. The lower driving bar 44 similarly includes a groove 52 in its forward face. The groove 52 houses the rearward end of a second drive member (not shown) of each of the 18D stitcher heads 12. The lower driving bar 44 is reciprocably driven by lever arms 54 (one shown).

Figure 5:
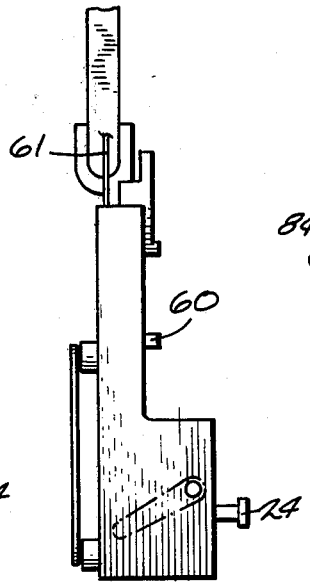
Fig. 5 (PRIOR ART)
FIG. 5 is a view similar to FIG. 4 but showing a prior art stitcher head.
Figure 6:
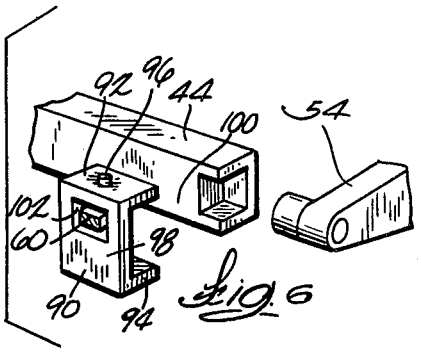
FIG. 6 is an exploded perspective view of a portion of the apparatus embodying the invention.

A conventional 26D stitcher head is illustrated in FIG. 5. The conventional 26D stitcher head shown in FIG. 5 includes a single reciprocal driven member or lug 60. A conventional stitching machine adapted to employ such a stitcher head includes only a single reciprocable horizontal drive bar. The single reciprocable driven lug 60 is functional to cause feeding of wire 61, bending, cutting, and driving of the formed wire into the magazine.

Figure 4:
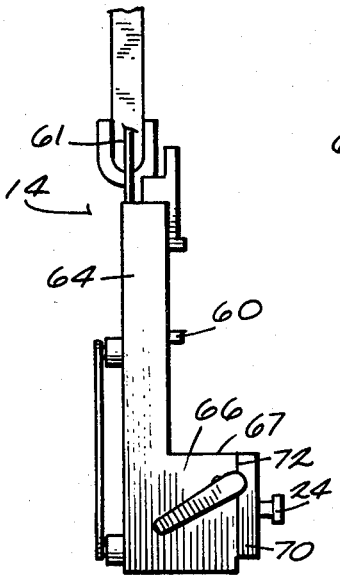
FIG. 4 is a side elevation view of the stitcher head shown in FIG. 3.

A 26D stitcher head 14 modified in accordance with the present invention is illustrated in FIGS. 1–4 so as to be operable with the stitching machine 10 rather than a conventional 26D stitcher machine having only a single driven bar. The stitcher head 14 includes a vertical body portion 64 and a rearwardly extending portion 66 integral with the lower end of the vertical body portion 64. As shown by a comparison of FIGS. 4 and 5, the rearwardly extending portion of the stitcher head 14 shown in FIG. 4 is modified such that the upper surface 67 of the rearwardly extending portion 66 is substantially lower than that of the 26D stitcher head of FIG. 5. Such modification of the 26D stitcher head permits the stitcher head 14 to be attached to the face of the machine 10 without interference with the projections 68 extending from the face of machine 10.

The modified stitcher head also includes a spacer plate 70 secured to the rearward vertical surface 72 of the rearwardly projecting member 66, the spacer plate 70 including a central bore 74 adapted to receive a forwardly projecting mounting or securing member 24. A transverse bore 80 extends through the rearwardly projecting member 66 and intersects the central bore 74, the transverse bore 80 being intended to house a mounting device latch 82, the mounting device latch 82 including a lever 84 attached to its outwardly extending end.

Means are also provided for coupling the reciprocating lower driving bar 44 to the single driving lug 60 of the modified stitcher head 14, such coupling means permitting overtravel of the driving bar 44 with respect to the driving lug 60 of the modified stitcher head 14. The lower drive bar 44 of the 18D stitcher machine 10 is driven through a vertical range of movement greater than the permissable travel of the driving lug 60. A coupling means is particularly provided for integrating the operation of these two members, the coupling means comprising a U-shaped bracket 90 adapted to clampingly engage the lower bar 44 of the stitching machine. The bracket 90 includes rearwardly extending upper and lower legs 92 and 94 engaging the respective upper and lower surfaces of the driving bar 44. A set screw 96 extends through a threaded bore in the upper leg 92 of the bracket 90 and engages the driving bar 44 to lock the bracket 90 in place. The bracket 90 also includes a vertical portion 98 positioned against the forward face 10 of the driving bar 44 and including an aperture 102 therein, the aperture 102 being adapted to loosely house the rearwardly extending lug or driving member 60 of the stitcher head 14. During downward reciprocal driving movement of the lower driving bar 44, the upper edge of the aperture 102 engages the driving lug 60 to cause downward movement of the driving lug only after the initial downward movement of the driving bar 44, and the lower edge of the aperture 102 will then contact the driving lug 60 only after an initial upward movement of the driving bar 44. By providing the bracket 90 with an aperture 102 larger than the lug 60 received therein, it is thus possible to have overtravel of the driving bar 44 with respect to the driving lug 60.

Various features of the invention are set forth in the following claims.

I claim:

1. Apparatus for use with a stitching machine and for use in forming staples from a continuous length of wire and for driving the staples into work, the stitching machine including:

a rigid frame having a generally vertical face, a first generally horizontal bar located adjacent said face, means for causing vertical reciprocal movement of said first bar, said first bar having a first range of movement, a second generally horizontal bar located adjacent said face and in vertically spaced relation from said first bar, and means for causing vertical reciprocal movement of said second bar, said apparatus comprising a stitcher head supported by said frame and including, a body having a rearward surface adapted to face said vertical face, and means for feeding, cutting, and shaping a continuous length of wire to form a staple and for driving said staple into the work, said means for feeding, cutting and shaping including movable members and a single driving lug drivingly connected to said movable members for driving said movable members, said driving lug being movable through a second range of vertical reciprocal movement less than said first range of movement of said first horizontal bar, and said driving lug projecting from said body rearward surface, and said apparatus comprising means for drivingly connecting said first horizontal bar to said driving lug for reciprocably driving said driving lug, said connecting means including an adapter member adapted to be fixed to said first horizontal bar and including means for driving said lug in response to reciprocal movement of said first bar.

2. Apparatus as set forth in claim 1 wherein said adapter member includes an aperture, said aperture being adapted to house said lug, and wherein said aperture in said adapter member is larger than said lug whereby said adapter member transmits downward movement of said first bar to said lug during a portion of the downward movement of the first bar and upward movement to the lug during a portion of the upward movement of the first bar.

3. Apparatus as set forth in claim 2 wherein said first bar moves between a lower position and an upper position, wherein said lug has a thickness in the vertical direction, and wherein said adapter transmits downward movement of said first bar to said lug when said first bar approaches its lower position and upward movement of said first bar to said lug when said first bar approaches its upper position, said aperture having a vertical dimension greater than the thickness of said lug.

4. Apparatus as set forth in claim 1 wherein said body includes a vertical portion having upper and lower ends and a projecting portion extending rearwardly from said lower end, and a spacer block secured to said rearwardly extending projection, said spacer block including means for engaging said frame.

5. Apparatus as set forth in claim 4 wherein said stitching machine includes means for securing said stitcher head to said frame, said securing means including a mounting member fixedly attachable to said frame and extending from the vertical face of the frame, and wherein said spacer block includes a first bore adapted to house said mounting member and a second bore extending through said projection and said spacer block, said second bore being transverse to said first bore in said spacer block and intersecting said first bore, and means for clamping said spacer block against said vertical face, said clamping means including a mounting device latch housed in said second bore and engageable with said mounting member.

6. Apparatus as set forth in claim 1 wherein said adapter comprises a bracket member having a pair of rearwardly extending arms adapted to be positioned on opposite sides of said first bar, and a vertical portion joining said rearwardly extending arms, said means for driving said lug including an aperture in said vertical portion, said aperture being adapted to house said lug.

7. Apparatus as set forth in claim 1 wherein said second bar is positioned above said first bar.

8. A stitching machine for driving staples into work, the stitching machine including a rigid frame having a generally vertical face, a first generally horizontal bar located adjacent said face, means for causing vertical reciprocal movement of said first bar, said first bar having a first range a movement, a second generally horizontal bar located adjacent said face and in vertically spaced relation from said first bar, means for causing vertical reciprocal movement of said second bar, a stitcher head supported by said frame and including a vertical body having a rearward surface adapted to face said vertical face, means for feeding, cutting, and shaping a continuous length of wire to form a staple and for driving said staple into the work, said means for feeding, cutting and shaping including movable members and a single driving lug drivingly connected to said movable members for driving said movable members, said driving lug being movable through a second range of movement less than said first range of movement of said first horizontal bar, and said driving lug projecting rearwardly from said body rearward surface, and means for drivingly connecting said first horizontal bar to said driving lug for reciprocably driving said driving lug, said connecting means including an adapter member fixed to said first horizontal bar and including means for driving said lug in response to reciprocal movement of said first bar.

9. A stitching machine as set forth in claim 8 wherein said means for driving said lug includes an aperture in said adapter member, said aperture being adapted to house said lug and wherein said aperture in said adapter member is larger than said lug whereby said adapter member transmits downward movement of said first bar to said lug during a portion of the downward movement of the first bar and upward movement to the lug during a portion of the upward movement of the first bar.

10. A stitching machine as set forth in claim 9 wherein said first bar moves between a lower position and an upper position, wherein said lug has a thickness in the vertical direction, and wherein said adapter transmits downward movement of said first bar to said lug when said first bar approaches its lower position and transmits upward movement of the first bar to said lug when said first bar approaches its upper position, said aperture having a vertical dimension greater than the thickness of said lug.

11. A stitching machine as set forth in claim 8 wherein said body includes a vertical portion having upper and lower ends and a projection extending rearwardly from said lower end, and a spacer block secured to said rearwardly extending projection, said spacer block including means for engaging said frame.

12. A stitching machine as set forth in claim 11 and further including means for securing said stitcher head to said frame, said securing means including a mounting member fixedly attachable to said frame and extending from the vertical face of the frame, and wherein said spacer block includes a first bore adapted to house said mounting member, and a second bore extending through said projection and said spacer block, said second bore being transverse to said first bore in said spacer block and intersecting said first bore, and means for clamping said spacer block against said vertical face, said clamping means including a mounting device latch housed in said second bore and engageable with said mounting member.

13. A stitching machine as set forth in claim 8 wherein said adapter comprises a bracket member having a pair of rearwardly extending arms adapted to be positioned on opposite sides of said first bar and to clampingly engage said first bar, and a vertical portion joining said rearwardly extending arms, said means for driving said lug including an aperture in said vertical portion, said aperture being adapted to house said lug.

14. A stitching machine as set forth in claim 8 wherein said second bar is positioned above said first bar.

* * * * *